United States Patent [19]

Yoshioka et al.

[11] Patent Number: 4,776,312

[45] Date of Patent: Oct. 11, 1988

[54] ENGINE ROUGHNESS CONTROL

[75] Inventors: Sadashichi Yoshioka; Haruo Okimoto; Kazuhiko Ueda; Nobuo Doi; Masahiko Matsuura, all of Hiroshima, Japan

[73] Assignee: Mazda Motor Corporation, Hiroshima, Japan

[21] Appl. No.: 73,879

[22] Filed: Jul. 10, 1987

Related U.S. Application Data

[63] Continuation of Ser. No. 771,730, Sep. 3, 1985, abandoned.

[30] Foreign Application Priority Data

Sep. 7, 1984 [JP] Japan ..... 59-188635

[51] Int. Cl.[4] ..... F02D 41/14; F02P 5/145

[52] U.S. Cl. ..... 123/436; 123/419

[58] Field of Search ..... 123/491, 492, 493, 421, 123/422, 423, 436, 419, 424

[56] References Cited

U.S. PATENT DOCUMENTS 4,422,421 12/1983 Ezoe ..... 123/424
4,509,484 4/1985 Gertiser ..... 123/436
4,552,113 11/1985 Williams ..... 123/436

FOREIGN PATENT DOCUMENTS 56-33571 8/1981 Japan .
58-187554 11/1983 Japan ..... 123/436

*Primary Examiner*—Andrew M. Dolinar
*Attorney, Agent, or Firm*—Fleit, Jacobson, Cohn & Price

[57] ABSTRACT

An engine control system having an engine vibration sensor which detects engine vibrations. A control circuit is provided for discriminating engine roughness wherein the engine vibration level is above a predetermined level and for decreasing the fuel supply continuously when engine roughness is not detected, in order to make the mixture leaner, but increasing the fuel supply when engine roughness is detected to make the mixture richer. A detector is provided for detecting a specific engine condition wherein the mixture is enriched for specific purposes. The control circuit is responsive to the output of the engine condition detector and discontinues the roughness control when the specific engine condition is detected.

2 Claims, 3 Drawing Sheets

ENGINE ROUGHNESS CONTROL

This application is a continuation of application Ser. No. 771,730, filed Sept. 3, 1985, now abandoned.

BACKGROUND OF THE INVENTION

1. Field of the Invention

The present invention relates to a control for internal combustion engines and more particularly to an engine control based on engine roughness.

2. Description of the Prior Art

In recent automobile engines, proposals have beem made, for the purpose of improving fuel economy, to detect engine roughness and to operate the engine at an extreme condition where the roughness is just about to occur. For example, in Japanese patent publication 56-33571, published on Aug. 4, 1981, there is disclosed an engine having an intake system including a main intake passage, and an auxiliary air passage for supplying a flow of adjusting air to the main intake passage. The system includes a control arrangement which detects the engine speed fluctuations to discriminate engine roughness and to decrease the flow of adjusting air through the auxiliary air passage, when the engine roughness is detected, to thereby enrich the mixture and suppress the engine roughness. This intake system is considered as being effective to decrease fuel consumption as much as possible without producing unacceptable engine torque fluctuations. Thus, the system can accomplish both riding comfort and fuel economy. Although the Japanese patent publication refers only to an engine roughness control based on the air-fuel ratio of the mixture, a similar control may be made based on other factors, such as ignition timing. For example, the ignition timing may be advanced as much as possible within a limit wherein the engine roughness does not occur.

In the case where the engine roughness control is accomplished through a control of air-fuel ratio, the roughness level increases as the mixture becomes leaner in normal operations so that the control system functions to increase fuel supply, or to decrease the adjusting air supply as taught by the Japanese patent publication, when engine roughness is detected. It should, however, be noted that the engine is operated under certain conditions with a richer mixture. For example, in the engine start and accelerating periods, the mixture to the engine is enriched relative to normal operation, and in this instance, the engine roughness level may be increased as the mixture becomes richer. It will therefore be understood that if the previously described roughness control is performed in a specific engine operating condition such as the engine start or the accelerating period, the air-fuel ratio may be controlled in a direction wherein the engine roughness level further increases. A similar problem will also be produced in the case where the ignition timing is controlled based on the engine roughness.

SUMMARY OF THE INVENTION

It is therefore an object of the present invention to provide an engine control system in which engine roughness can be suppressed throughout the engine operating range.

Another object of the present invention is to provide an engine control system based on the engine roughness level and in which the engine roughness can be suppressed even under an engine operating condition wherein the engine is operated with a richer air-fuel mixture or with a retarded ignition timing.

In order to accomplish the above and other objects, the present invention provides a control system based on the engine roughness level, in which the roughness control is discontinued in the aforementioned specific engine operating condition wherein the engine is operated with a richer mixture or with a retarded ignition timing. According to the present invention, there is provided an engine control system including engine operating condition detecting means for detecting an engine operating condition, engine combustion control means for controlling at least one factor which affects conditions of combustion in the engine, actuating means connected with said engine operating condition detecting means to receive an engine operating condition signal therefrom and produce an output for actuating the engine combustion control means, roughness detecting means for detecting engine vibrations caused by changes in combustion in the engine, modifying means responsive to an output of the roughness detecting means to modify the output of the actuating means, specific condition detecting means for detecting a specific condition wherein the condition of combustion changes momentarily, and roughness control discontinuing means responsive to an output from the specific condition detecting means to discontinue operation of the modifying means. The engine combustion control means may, for example, be an air-fuel ratio control device. Alternatively, it may be an ignition timing control device.

According to the features of the present invention, the roughness control under the function of the modifying means is discontinued in a specific engine operating condition wherein the condition of combustion changes momentarily. For example, the specific condition may be a condition wherein the engine is operated with a richer mixture or with a retarded ignition timing. Therefore, it is possible to prevent the engine roughness level from being increased due to the operation of the modifying means.

The above and other objects and features of the present invention will become apparent from the following description of a preferred embodiment, taking reference to the accompanying drawings.

DESCRIPTION OF THE PREFERRED EMBODIMENT

Figure 1:
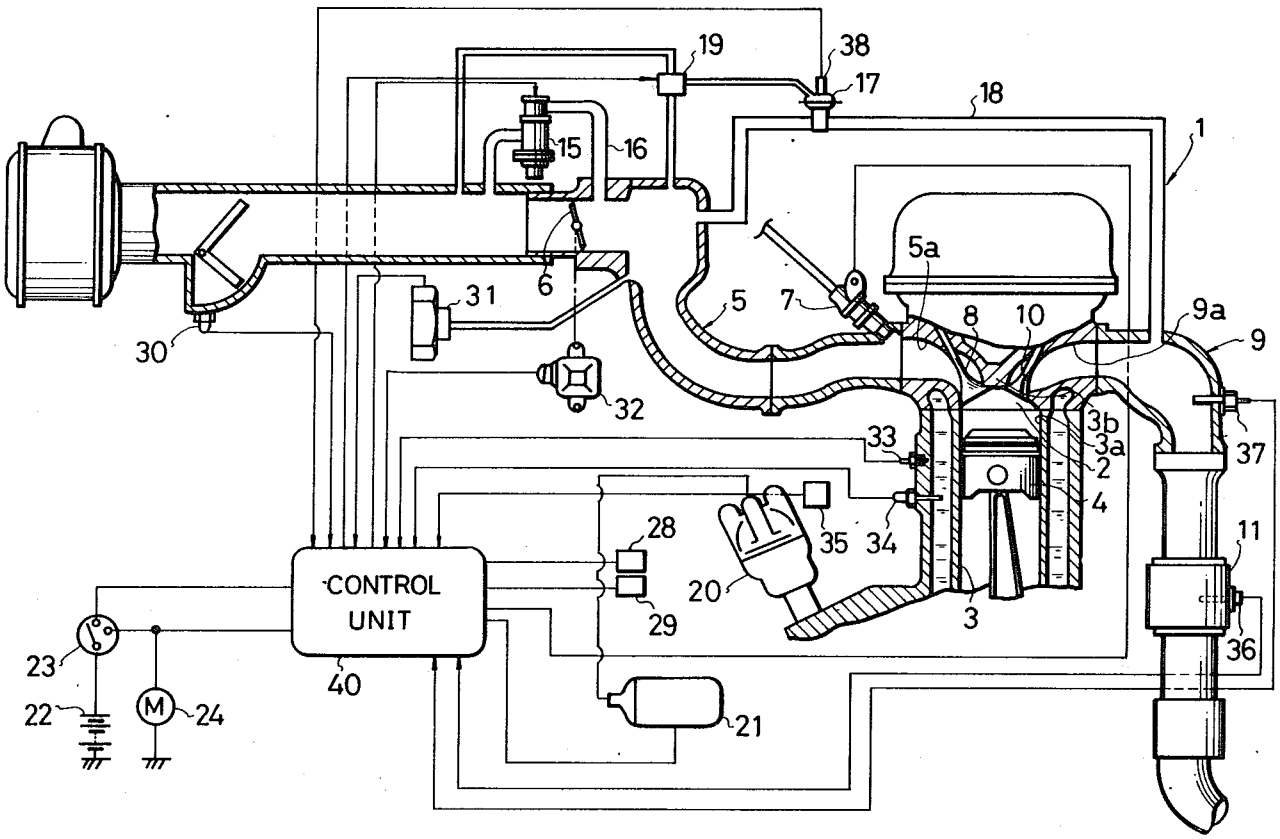
FIG. 1 is a sectional view of an engine having an engine control system in accordance with one embodiment of the present invention.

Referring to the drawings, particularly to FIG. 1, there is shown an engine 1 including a cylinder block 3 formed with a cylnder bore **3*a* and a cylinder head 3*b* attached to the cylinder block 3. In the cylinder bore 3*a*, there is disposed a piston 4 which is adapted for reciprocating movements therein. The cylinder block 3, the cylinder head 3*b* and the piston 4 together define a combustion chamber 2. The cylinder head 3*b* is formed with an intake port 5*a* and an exhaust port 9*a* which are connected, respectively, with an intake passage 5 and an exhaust passage 9. The intake port 5a and the exhaust port 9a are respectively provided with an intake valve 8 and an exhaust valve 10**.

In the intake passage 5, there is provided a throttle valve 6. A fuel injection valve 7 is provided in the intake passage 5 in the vicinity of the intake port 5a. The exhaust passage 9 is provided with a catalytic device 11. A bypass passage 16 is provided in the intake passage 5 across the throttle valve 6 and a bypass control valve 15 is in the bypass passage 16. Between the intake passage 5 and the exhaust passage 9, there extends an exhaust gas recirculation passage 18 which has an exhaust gas recirculation control valve 17. The exhaust gas recirculation control valve 17 is of a type that is actuated under a suction pressure. For controlling the supply of the suction pressure to the valve 17, there is provided a solenoid valve 19. Although not shown in FIG. 1, the engine 1 has an ignition plug which is mounted on the cylinder head, and a distributor 20 and an ignition coil 21 are provided for energizing the ignition plug.

In order to control the fuel supply to the fuel injection valve 7 and the ignition timing, the engine 1 is provided with a control unit 40. As the electrical power source, there is provided a battery 22 which is connected through a main switch 23 with the control unit 40. The main switch 23 further controls the power supplied to a starter motor 24.

The engine 1 has an airflow sensor 30 provided in the intake passage 5 for detecting the intake airflow. In the intake passage 5, there is further provided an intake pressure sensor 31 which detects the intake pressure downstream of the throttle valve 6. The position of the throttle valve 6 is detected by a throttle position sensor 32. In order to detect the engine roughness in terms of the engine vibrations caused by unstable combustion, the cylinder block 3 is provided with a roughness sensor 33 which detects vibrations of the cylinder block 3. The engine 1 is also provided with a cooling water temperature sensor 34 for detecting the engine cooling water temperature and an engine speed sensor 35 for detecting the engine speed. On the catalytic device 11, there is a catalyst temperature sensor 36 for detecting the temperature of the catalyst in the device 11. In the exhaust passage 9, there is provided an $O_2$ sensor 37. Further, the exhaust gas recirculation control valve 17 is provided with a valve position sensor 38. The engine 1 is mounted on a vehicle having a power transmission which is provided with a shift sensor 28 for detecting that the transmission is being shifted. Further, the engine 1 is provided with an engine load sensor 29 which detects the loads on the engine applied by auxiliary equipment of the vehicle. The output signals from the sensors 30 to 38 are applied to the control unit 40.

Figure 2:
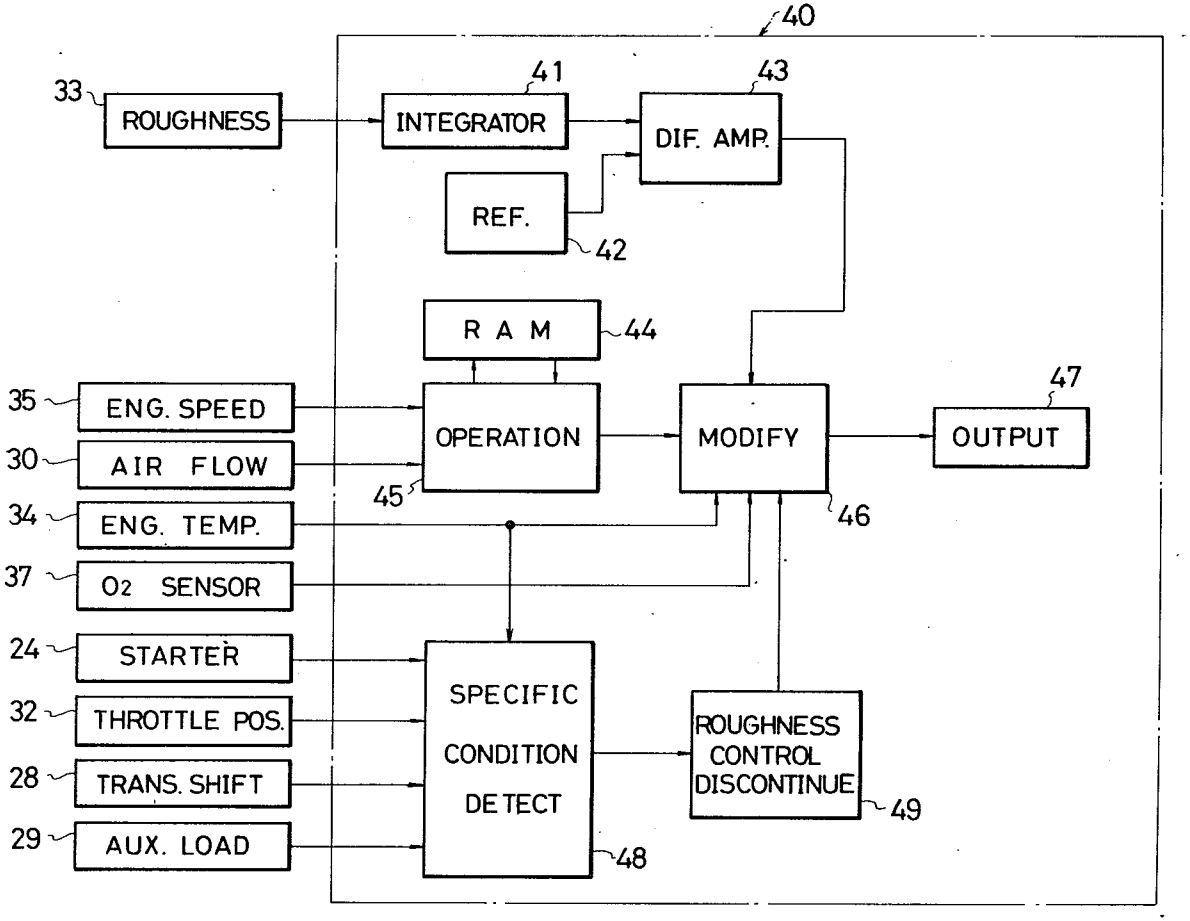
FIG. 2 is a block diagram showing the details of the control unit.

As shown in FIG. 2, the control unit 40 includes an integrator 41 which is connected with the roughness sensor 33. The integrator 41 functions to integrate the vibration signals from the sensor 33 and perform an analogue-digital conversion to produce a digital output. The output of the integrator 41 is connected with a differential amplifier 43. A reference circuit 42 is provided for applying a reference signal to the differential amplifier 43 so that the engine vibration signal from the integrator 41 is compared with the reference signal. The control unit 40 further includes a RAM 44 which memorizes basic fuel supply quantities for various engine operating conditions which are determined by the engine speed and the intake airflow. An operation circuit 45 is connected with the RAM 44 for reading an appropriate one of the basic fuel supply quantities memorized in the RAM 44 in accordance with the engine operating condition. For that purpose, the operation circuit 45 is connected with the engine speed sensor 35 and the airflow sensor 30. The output of the operation circuit 45 is applied to a modifying circuit 46 which is also connected with the output of the differential amplifier 43. The modifying circuit 46 is further connected with the cooling water temperature sensor 34 and the $O_2$ sensor 37. The modifying circuit 46 functions to modify the basic fuel quantity signal from the operation circuit 45 in accordance with the signal from the differential amplifier 43 and the signals from the sensors 34 and 37. The output of the modifying circuit 46 is applied to an output circuit 47 which produces an output for energizing the fuel injection valve 7 to provide the required supply of fuel to the engine 1.

It will be noted in FIG. 2 that the control unit 40 is further provided with a specific condition detecting circuit 48 which is connected with the outputs of the throttle valve position sensor 32, the shift sensor 28, the load sensor 29 and the cooling water temperature sensor 34. The circuit 48 is also connected to the starter motor 24 so as to detect that the starter motor 24 is in operation. The detecting circuit 48 has an output connected with a roughness control discontinuing circuit 49 which is in turn connected with the modifying circuit 46. The detecting circuit 48 functions to discriminate engine conditions wherein the engine is operated momentarily with a rich mixture. Such engine conditions include the engine starting period, acceleration, deceleration, the shifting period of the transmission, the time when the auxiliary equipment has just been turned on, and/or the engine warming up period. The roughness control discontinuing circuit 49 functions to make the modifying circuit 46 inoperative when the output from the detecting circuit 48 is received.

Figure 3:
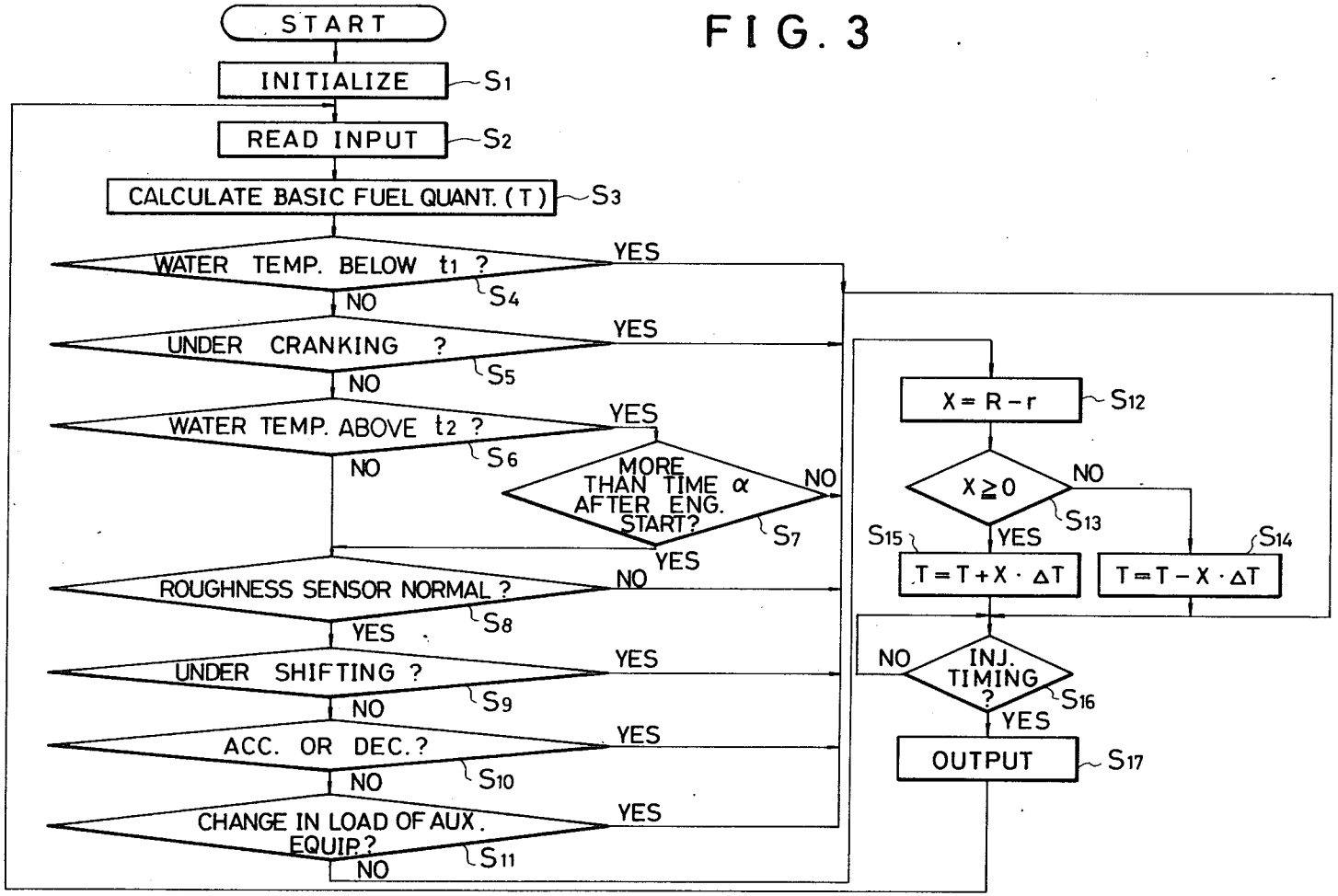
FIG. 3 is a program flow chart showing the operation of the control unit.

In operation of the control unit 40, the unit 40 is at first initialized in step $S_1$, as shown in FIG. 3, and then input signals are read in step $S_2$ by the circuits 45, 46 and 48. Thereafter, the basic fuel supply quantity T is read from the RAM 44 in step $S_3$ by the operating circuit 45 in accordance with the engine speed and the intake airflow.

Then, a judgement is made in step $S_4$ by the circuit 48 as to whether the engine cooling water temperature is below a predetermined value $t_1$, for example 60 C. If it is judged that the engine cooling water temperature is above the value $t_1$, it is judged that the engine warming up is finished and a step $S_5$ is carried out. In the step $S_5$, a judgement is further made as to whether the starter 24 is being operated. If the answer is NO, it is judged that the engine is not in the starting period so that the mixture enrichment is not made for the engine start. Then, a step $S_6$ is carried out to judge whether the engine cooling water temperature is above a value $t_2$, for example, 90 C. If it is detected that the temperature is above the value $t_2$, a further judgement is made in step $S_7$ as to whether a predetermined time $\alpha$, for example, 10 seconds, has passed. If the answer in the step $S_7$ is YES, it is judged that the mixture is no longer enriched even under a hot engine start by the evaporated fuel because the evaporated fuel must have been burnt already. Then, a step $S_8$ is carried out to check as to whether the roughness sensor is normally operating. When the result of the judgement in step $S_6$ is NO, it is also judged that the mixture is not enriched by the evaporated fuel so that the process goes to the step $S_8$.

When the answer in the step $S_8$ is YES, it is judged that roughness control can be made so that steps $S_9$, $S_{10}$ and $S_{11}$ are sequentially carried out to judge as to whether the transmission is being shifted, whether the engine is in acceleration or deceleration and whether there is a change in the load of auxiliary equipment. If the answers in the steps $S_9$, $S_{10}$ and $S_{11}$ are all NO, it is judged that no fuel enrichments are made for these specific operations so that a step $S_{12}$ is carried out to compare the engine roughness signal R with a reference signal r to obtain a difference $X=R-r$ and a judegement is made in step $S_{13}$ as to whether the difference x is not smaller than 0. When the difference x is smaller than 0, the basic fuel supply quantity T is modified in step $S_{14}$ by the formula $T=T-X\cdot\Delta T$ to decrease the fuel supply. When the difference is equal to or larger than 0, the quantity T is modified in step $S_{15}$ by the formula $T=T+x\cdot\Delta T$ to increase the fuel supply. Thereafter, the fuel injection timing is judged in step $S_{16}$ and the output for the fuel injection is produced in step $S_{17}$ in accordance with the modified fuel supply quantity. After the step $S_{17}$, the process is repeated from the step $S_2$. Thus, as far as the engine roughness level is below a limit, the fuel supply is stepwisely decreased to make the mixture leaner, and once the roughness level exceeds the limit, the fuel supply is increased.

When it is found that the engine cooling water temperature is below the value $t_1$, it is judged that the engine is in the warming up period in which the mixture is enriched. Then, the process goes directly to the step $S_{16}$. When he answer in the step $S_5$ is that the engine is being started, it is also judged that a starting enrichment of the mixture is made. Further, when the engine cooling water temperature is found in the step $S_6$ as being above the value $t_2$ but the time from the engine start is found in the step $S_7$ as being less than the value $\alpha$, it is judged that the mixture is rich because of the evaporated fuel. Under these conditions, the process is also proceeded directly to the step $S_{16}$.

Further, it the judgements in the steps $S_9$, $S_{10}$ or $S_{11}$show that the transmission is being shifted, the engine is under acceleration or deceleration or the load imposed by the auxiliary equipment has been changed, it is judged that an enrichment has been made so that the process proceeds to the step $S_{16}$. Thus, under a specific engine operating condition wherein the mixture to the engine is rich, the steps $S_{12}$through $S_{15}$ for the roughness control are skipped. In the case where a judgement is made in the step $S_8$ that the operation of the roughness sensor is abnormal, it is judged that the roughness control is impossible so that the process goes directly to the step $S_{16}$.

It will be understood that, with the control system described above, it is possible to carry out the control based on engine roughness without having a risk of engine vibrations under specific engine operating conditions as described. It will also be understood that the present invention can also be applied to a control system wherein the ignition timing is controlled in accordance with the engine roughness level. The engine roughness level can be detected in terms of engine vibrations, fluctuations of the engine output shaft speed or fluctuations of the output torque.

The invention has thus been shown and described with reference to a specific embodiment. However, it should be noted that the invention is in no way limited to the details of the illustrated embodiment, and changes and modifications may be made without departing from the scope of the appended claims.

We claim:

1. An engine control system for a vehicle having a transmission, said control system including engine operating condition detecting means for detecting an engine operating condition, engine combustion control means for controlling at least one factor which affects conditions of combustion in the engine, actuating means connected with said engine operating condition detecting means to receive an engine operating condition signal therefrom and to produce an output for actuating the engine combustion control means, roughness detecting means for detecting engine vibrations caused by changes in combustion in the engine, modifying means responsive to an output of the roughness detecting means to modify the output of the actuating means, specific condition detecting means for detecting a specific condition wherein the condition of combustion changes momentarily, and roughness control discontinuing means responsive to an output from the specific condition detecting means to discontinue operation of the modifying means, wherein said specific condition is a condition wherein the transmission is being shifted.

2. An engine control system in which the engine is for a vehicle having an auxiliary facility, said control system including engine operating condition detecting means for detecting an engine operating condition, engine combustion control means for controlling at least one factor which affects conditions of combustion in the engine, actuating means connected with said engine operating condition detecting means to receive an engine operating condition signal therefrom and to produce an output for actuating the engine combustion control means, roughness detecting means for detecting engine vibrations caused by changes in combustion in the engine, modifying means responsive to an output of the roughness detecting means to modify the output of the actuating means, specific condition detecting means for detecting a specific condition wherein the condition of combustion changes momentarily, roughness control discontinuing means responsive to an output from the specific condition detecting means to discontinue operation of the modifying means, wherein said specific condition is an instance wherein the load of the auxiliary facility is just applied to the engine

* * * * *